United States Patent [19]

Kataishi et al.

[11] 4,421,130

[45] Dec. 20, 1983

[54] CORROSION PROTECTION PRETREATING APPARATUS

[75] Inventors: Takao Kataishi; Nobufumi Yokoi, both of Tokyo, Japan

[73] Assignee: Misawa Home Co., Ltd., Tokyo, Japan

[21] Appl. No.: 320,627

[22] Filed: Nov. 12, 1981

[30] Foreign Application Priority Data

May 30, 1981 [JP] Japan ..... 56-82712

[51] Int. Cl.[3] ..... B08B 3/04

[52] U.S. Cl. ..... 134/76; 134/83

[58] Field of Search ..... 134/66, 76–77, 134/82–83, 165; 414/560

[56] References Cited

U.S. PATENT DOCUMENTS 2,158,687 5/1939 Biggert, Jr. et al. ..... 134/76 X
3,106,927 10/1963 Madwed ..... 134/76
3,658,197 4/1972 Didonato ..... 134/76 X

FOREIGN PATENT DOCUMENTS 2444161 4/1976 Fed. Rep. of Germany ..... 134/66

*Primary Examiner*—Robert L. Bleutge
*Attorney, Agent, or Firm*—Flynn, Thiel, Boutell & Tanis

[57] ABSTRACT

A corrosion protection pretreating apparatus, wherein articles to be treated such as reinforcement-arranged frame or the like are subjected to pickling prior to the corrosion protection treatment including mortar coating and the like. A carry-in section for the articles to be treated is provided at one side of a section of five treating tanks including a degreasing tank, a first rinsing tank, a pickling tank, a second rinsing tank and a neutralizing tank, an article, which has been carried into this carry-in section, is supported by a carrier bar, this carrier bar is transferred to an intermediate portion of the section of the plurality of treating tanks by a first transfer device formed into a travelling crane while being successively immersed into the treating tanks, then, the carrier bar, which has been transferred to the intermediate position, is carried to a carry-out section for the articles to be treated and finally carried out therefrom by a second transfer device also formed into a travelling crane while being successively immersed in the remaining treating tanks.

5 Claims, 6 Drawing Figures

CORROSION PROTECTION PRETREATING APPARATUS

BACKGROUND OF THE INVENTION

1. Field of the Invention

This invention relates to a corrosion protection pretreating apparatus, wherein, for example, when a mortar coating or the like is applied to an article to be treated such as a reinforcement-arranged frame for a concrete panel for being protected against corrosion, the reinforcement-arranged frames are subjected to pickling and the like prior to the corrosion protection treatment.

2. Description of the Prior Art

Heretofore, the apparatuses of the type described have not been much automatically operated, and the article to be treated have been manually immersed successively in treating tanks including a degreasing tank, a rinsing tank, a pickling tank, another rinsing tank, a neutralizing tank and the like, or have been suspended from lifting hooks secured to an endless chain and lowered together with the endless chain to be successively immersed in the aforesaid treating tanks.

However, in the former, the operation is carried out at a very low efficiency, and in the latter, although the workability is higher than in the former, it is not applicable to the operation when the periods of time required for the treatments in the respective treating tanks are different from one another, thus lacking the production flexibility.

SUMMARY OF THE INVENTION

The present invention has as its object the provision of a corrosion protection pretreating apparatus having a high operation efficiency and a high production flexibility, under which the apparatus can be readily accommodated to the changes in the treating steps.

The present invention contemplates to provide a corrosion protection pretreating apparatus, wherein a carry-in section for the articles to be treated is provided at one side of a section including a plurality of treating tanks, a carry-out section for the articles to be treated is provided at the other side of the section of the treating tanks, a plurality of carrier bars are provided, which support the articles to be treated and are moved together with the articles to be treated from the carry-in section to the carry-out section through the section of the treating tanks, and a first transfer device and a second transfer device are provided, the first transfer device being movable between the carry-in section and predetermined positions over the treating tanks while supporting the article to be treated and the second transfer device being movable between predetermined positions over the respective treating tanks and carry-out section with its scope of movement being partially overlapped with that of the first transfer device, whereby the articles to be treated are successively transferred by means of the first and second transfer devices from the carry-in section to the carry-out section through the section of the treating tanks, while being treated in the respective treating tanks, so that the movements of the first and second transfer devices can be suitably accommodated to the number of the treating tanks and the periods of time required for the treatments in the respective treating tanks and automatically operated by means of a sequence control or the like, thereby enabling to achieve the abovedescribed object.

DETAILED DESCRIPTION OF THE PREFERRED EMBODIMENT

Figure 1:
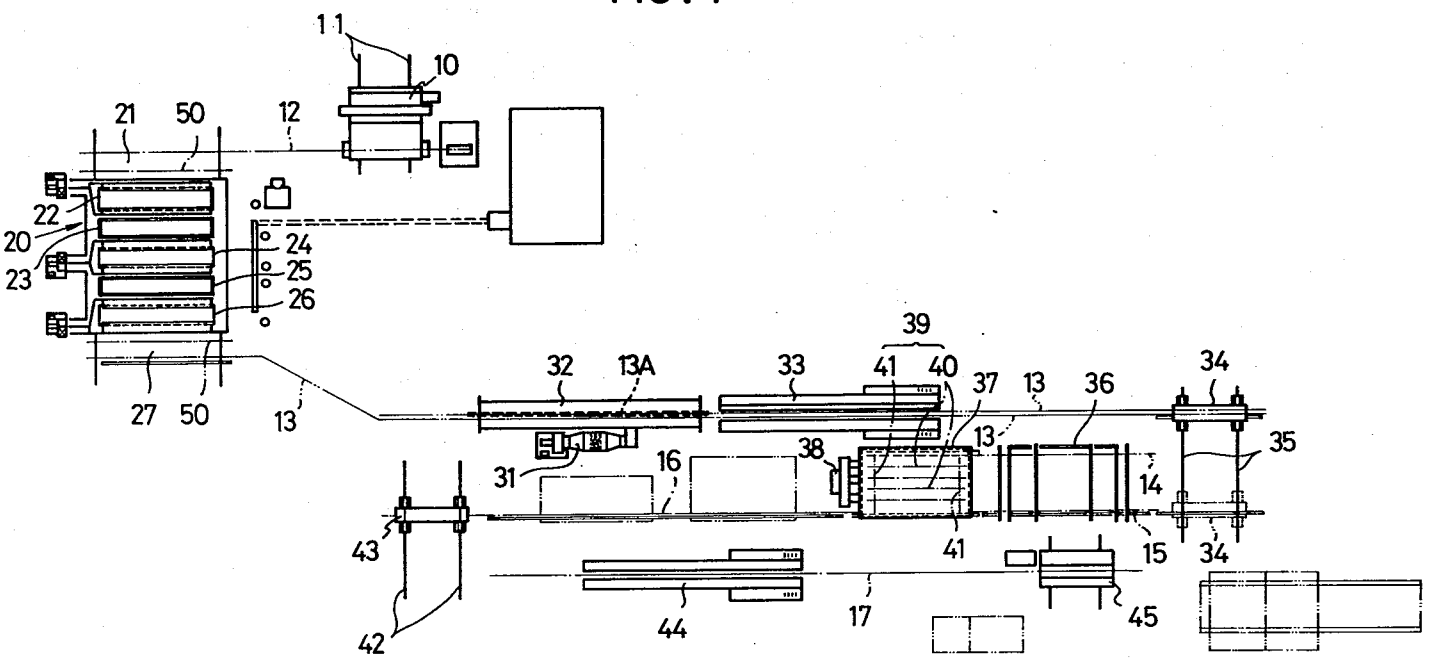
FIG. 1 is a plan view showing the general arrangement of a corrosion protection treating system including an embodiment of the corrosion protection pretreating apparatus according to the present invention.

FIG. 1 shows a corrosion protection treating system including therein a corrosion protection pretreating apparatus according to the present invention. In the drawing, an automatically operated first traverser 10 for carrying in articles 110 (Refer to FIG. 3) such as reinforcement-arranged frame and the like for a concrete panel, which is constructed such that round steel bars are welded to a frame in lengthwise and crosswise manner, is adapted to be movable on a pair of carry-in rails 11, and a suspending rail 12 formed of an I-steel is provided at the tail end portion of this carry-in rails 11 in a direction perpendicularly intersecting the carry-in rails 11. This suspending rail 12 is provided at a height sufficient for suspending the article, which has been carried in by means of the traverser 10 through lifting devices 100 having wheels to be secured to the top end of the article 110 to be treated (Refer to FIGS. 4 and 5). Additionally, this suspending rail 12 is extended to a carry-in section 21 for the article to be treated disposed at one side of a corrosion protection pretreating apparatus 20 according to the present invention.

The corrosion protection pretreating apparatus 20 is provided therein with a plurality, five for example, of treating tanks successively arranged from the carry-in side, including a degreasing tank 22, a first rinsing tank 23, a pickling tank 24, a second rinsing tank 25 and a neutralizing tank 26, and the degreasing tank 22 is filled up with an alkaline liquid such as sodium orthosilicate or the like, the pickling tank 24 with a rust removing liquid such as phosphoric acid or sulphuric acid, and the neutralizing tank 26 with a neutralizing liquid such as sodium sulfite. In this case, as the rust removing liquid, phosphoric acid is most preferable because it is satisfactorily spread over the entire reinforcement-arranged frame of the concrete panel being the article to be treated.

A suspending rail 13 similar to the aforesaid suspending rail 12 is drawn out from a carry-out section 27 for the article to be treated provided at the other side of the corrosion protection pretreating apparatus 20 in a direction perpendicularly intersecting the flowing direction of the corrosion protection pretreating apparatus 20. This suspending rail 13 is extended through a drain-and-dry furnace 32 having a hot air blower 31 and a masking workboard 33, reaches a position where a second traverser 34 is disposed, is provided at a portion thereof from the inlet side of the drain-and-dry furnace 32 to the traverser 34 with a pair of rails, and further, and additionally provided at a portion thereof in the drain-and-dry furnace 32 with a chain conveyer 13A having dogs, so that an automatic feed can be performed. Furthermore, the second traverser 34 is movable on a pair of rails 35 in a direction perpendicularly intersecting the aforesaid suspending rail 13.

A suspending rail 14 is provided at a position on the side of the second traverser 34 in parallel to the aforesaid suspending rail 13 and at the same side as the suspending rail 13. This suspending rail 14 is extended through a corrosion protection treating tank 36 for coating the outer perpheral surface of the reinforcement-arranged frame with mortar to protect against corrosion and reaches to a corrosion protection drying chamber 37. This corrosion protection drying chamber 37 has a hot air blower 38 for blowing out a hot air from beneath the corrosion protection drying chamber 37 and further has a transfer mechanism 39, which is constructed such that portions close to opposite ends of a plurality of movable rails 40 formed of I-steels similar to those used for the suspending rails 12, 13 and 14 are connected to one another by use of endless chains 41, so that the reinforcement-arranged frame suspended through the lifting devices 100 each having wheels between the movable rails 40 from above can be transferred from one side to the other side of the drying chamber 37, while the mortar adhered to the reinforcement-arranged frame is being dried.

A conveyer 15 for the repeated treatment, in which a chain having dogs is added to a suspending rail, is provided at one side portion of the other side of the drying chamber 37, i.e. to the right in FIG. 1. A reinforcement-arranged frame being imperfect in corrosion protection treating or requiring careful corrosion protection due to severe conditions of the environment of installation passes through this conveyer 15 for repeated treatment and returned to the second traverser 34, whence the reinforcement-arranged frame is returned to the corrosion protection treating tank 36. Furthermore, a finished article conveyer 16, in which a chain having dogs is added to a suspending rail, is provided at the other side portion of the other side of the drying chamber 37, i.e. to the right in FIG. 1. This finished article conveyer 16 is extended to a position, where a third traverser 43 is disposed, which is movable on rails 42 extending in a direction perpendicularly intersecting the finished article conveyer 16. A suspending rail 17 is provided at a position on the side of the third traverser 42 in parallel to the finished article conveyer 16 and at the same side as the finished article conveyer 16. This suspending rail 17 is extended through a masking removing workboard 44 and reaches a position, where an automatically operated traverser 45 having a lifter is provided.

Figure 2:
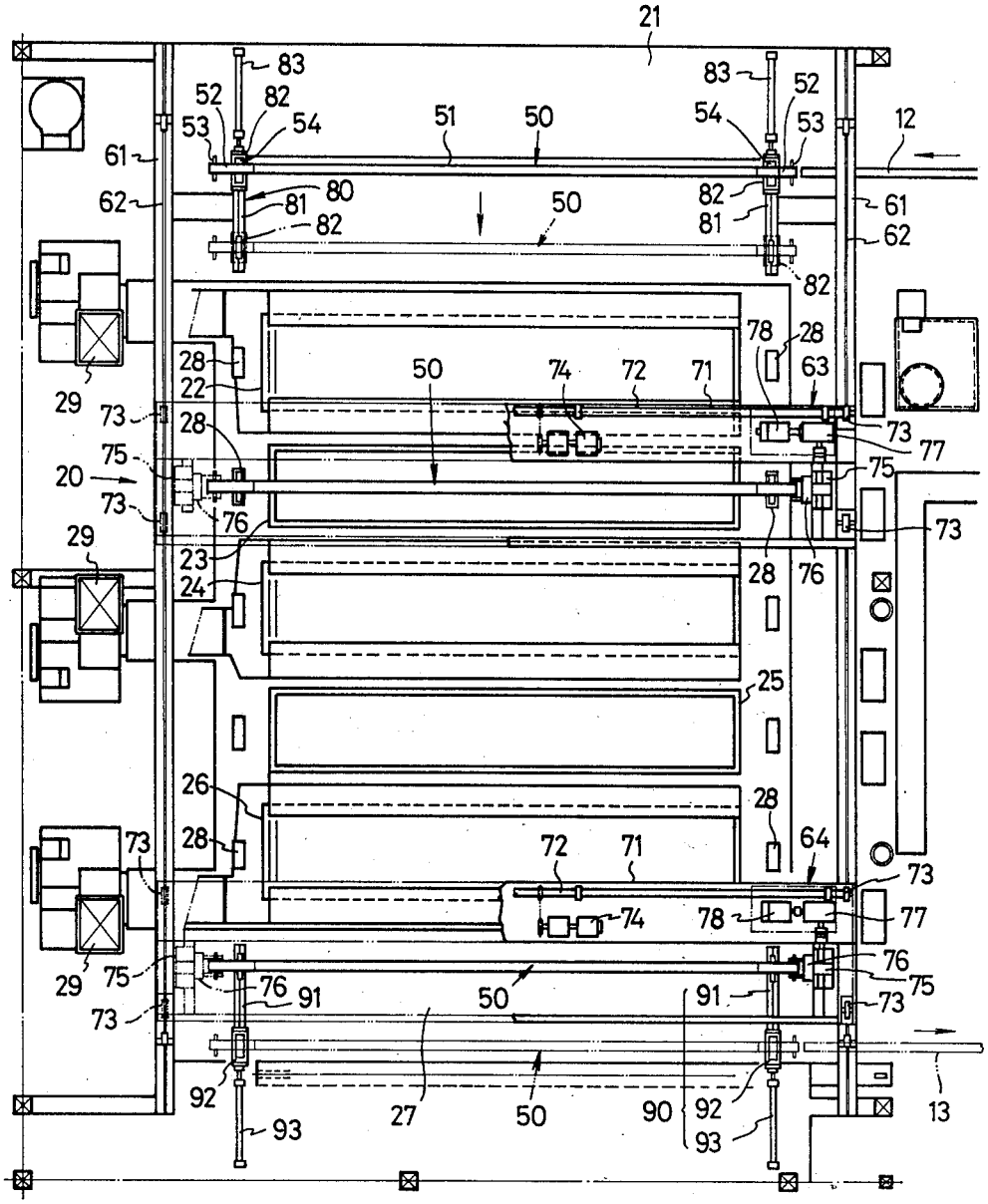
FIG. 2 is an enlarged plan view showing the embodiment of the corrosion protection pretreating apparatus according to the present invention.
Figure 3:
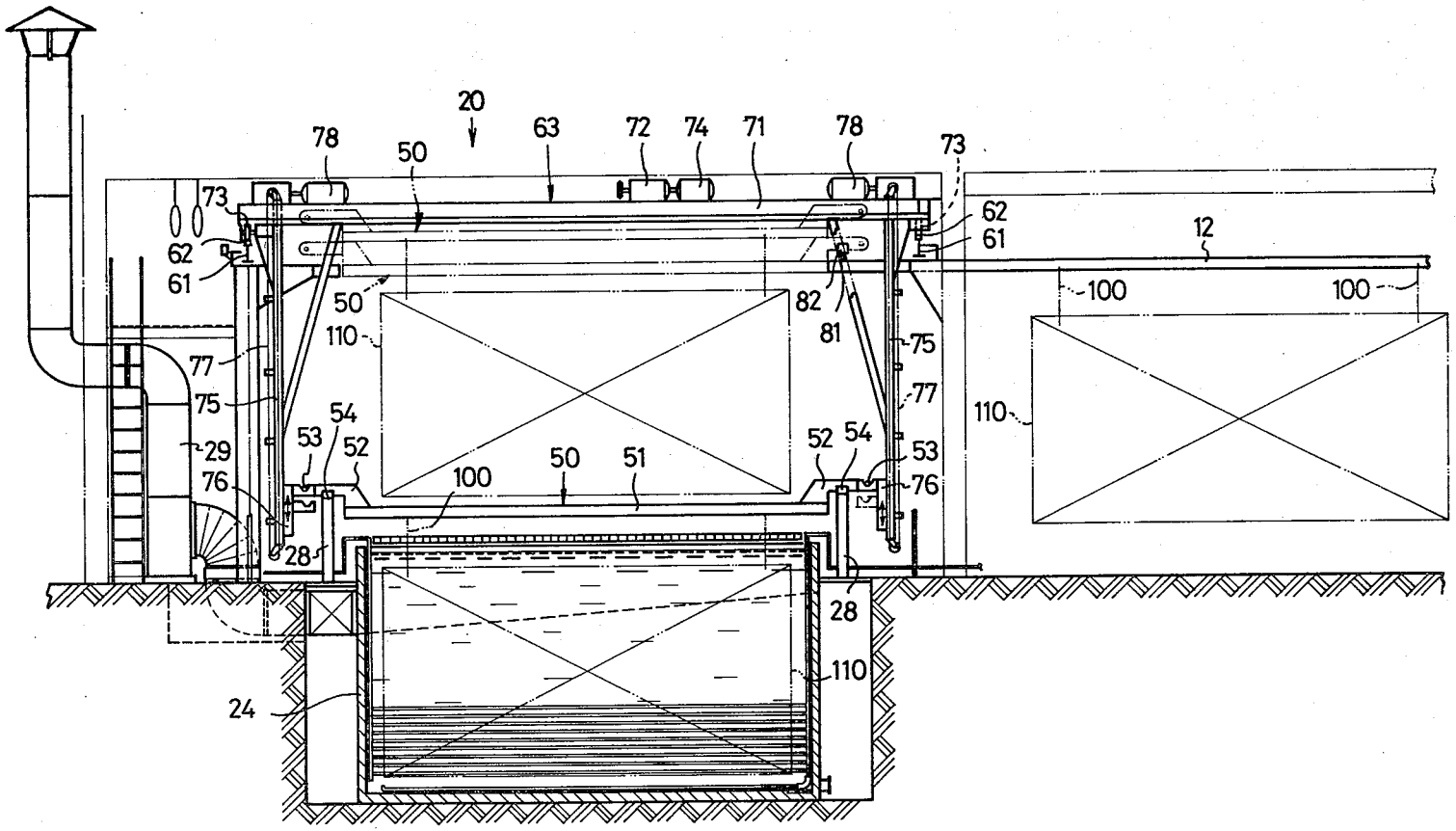
FIG. 3 is a sectional view thereof.

FIGS. 2 and 3 show the corrosion protection pretreating apparatus 20 in detail. This corrosion protection pretreating apparatus 20 is provided therein with a plurality, four for example, of carrier bars 50, which comprises: a support rail 51 formed by cutting an I-steel similar to the aforesaid suspending rails 12, 13 and so forth to a predetermined length; a pair of key-shaped brackets 52 fixed at opposite end portions of this support rail 51, the brackets 52 being directed upwardly in directions opposite to each other; support projections 53 projectingly provided at opposite sides of the forward end portion of each of the brackets 52, respectively; and receiving seats 54 made of rubber provided at positions slightly inwardly of the support projections 53 in a manner to cover a part of the undersurface of the brackets 52.

Erected at positions on opposite sides of the treating tanks 22 through 26 of the corrosion protection pretreating apparatus 20 are support frames 61. A first and a second transfer devices 63 and 64 each having a construction of a crane shape and entirely identical with each other are movable on rails 62 laid on these support frames 61.

Since the first and the second transfer devices 63 and 64 are of the constructions entirely identical with each other, explanations of the both transfer devices 63 and 64 will be given at the same time, with same reference numerals being used to designate the similar parts. Each of the transfer devices 63 and 64 comprises: a frame 71 racked across the opposing rails 62; a travel driving source 74, such as a motor, provided on the frame 71 for driving wheels 73 through an interlocking mechanism including a reduction gear, a sprocket, a chain and a connecting shaft and the like; a pair of guide supports 75, the upper ends of which are secured to the opposite sides of the frame 71 and the lower ends of which are suspended to positions close to the ground; movable brackets 76 vertically movably secured to the guide supports 75 and capable of supporting the support projections 53 of the carrier bar 50; and lifting driving sources 78, such as motors, provided at the opposite side portions of the frame 71, respectively, for vertically moving the movable brackets 76, respectively, through interlocking mechanisms, each of which includes a reduction gear, a sprocket, a chain and the like. In this case, the supports 75, the movable brackets 76, interlocking mechanisms 77 and the lifting driving sources 78 constitute the lifting mechanism. Furthermore, the first transfer device 63 is movable between the carry-in section 21 for the article to be treated and the predetermined positions over the respective treating tanks 22 through 26 within a scope not interfering with the second transfer device 64, while the second transfer device 64 is movable between the predetermined positions over the respective treating tanks 22 through 26 and the carry-out section 27 for the article to be treated within a scope not interfering with the first transfer device 63, these first and second transfer 63 and 64 can be automatically or manually operated in response to detection signals fed from detection switches and the like, not shown, provided at various positions of the corrosion protection pretreating apparatus 20.

The carry-in section 21 for the article is provided therein with a carry-in carrier bar transfer device 80, which comprises: a pair of guide rails 81 provided at positions opposed to the receiving seats 54 provided at positions adjacent the opposit ends of the carrier bar 50; a pair of movable bases 82 movable on these guide rails 81 and supporting the receiving seats 54, respectively, in such a manner that, in their states of supporting the receiving seats 54, the height of the support rail 51 comes in register with the height of the suspending rail 12; and a pair of pusher cylinders 83 secured at the forward ends of piston rods thereof to these movable bases 82 for linearly moving the movable bases 82; so that these pusher cylinders 83 can drive the carrier bar 50 to move from a carry-in position being in register with the direction of an extension line of the suspending rail 12 to a carrier bar delivering and receiving position adjacent the degreasing tank 22 or vice versa.

The carry-out section 27 for the article to be treated is provided therein with a carry-out carrier bar transfer device 90 similar in construction to the aforesaid carry-in carrier bar transfer device 80. The carrier bar transfer device 90 comprises: a pair of guide rails 91 provided at positions opposed to the receiving seats 54 provided at positions adjacent the opposite ends of the carrier bar 50; a pair of movable bases 92 movable on these guide rails 91 for supporting the receiving seats 54, respectively, in such a manner that, in their states of supporting the receiving seats 54, the height of the support rail 51 comes into register with the height of the suspending rail 13; and a pair of pusher cylinders 93 for linearly moving these movable bases 92, so that these pusher cylinders 93 can drive the carrier bar 50 to move from a carry-our position being register with the direction of extending the suspending rail 13 to a carrier bar delivering and receiving position adjacent the second rinsing tank 26 or vice versa.

Each one receiving base 28 is erected at a position opposed to the receiving base 54 of the carrier bar 50 adjacent the opposite sides of the respective treating tanks 22 through 26, so that the carrier bar 50, which has been delivered to one of the respective treating tanks 22 through 26, can be supported on these receiving bases 28. In this case, the heights of the receiving bases 28 are determined to be ones necessary and sufficient for suitably immersing the article 110 to be treated, being suspended from the carrier bar 50 in one of the treating tanks 22 through 26, in a state of the carrier bar 50 being rested on the receiving bases 28.

Figure 4:
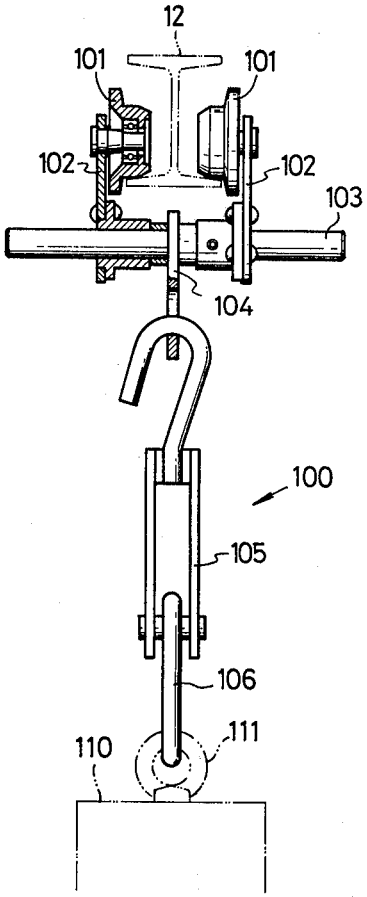
FIG. 4 is a partially cut-away front view showing a lifting device with wheels used in the corrosion protection treating system.
Figure 5:
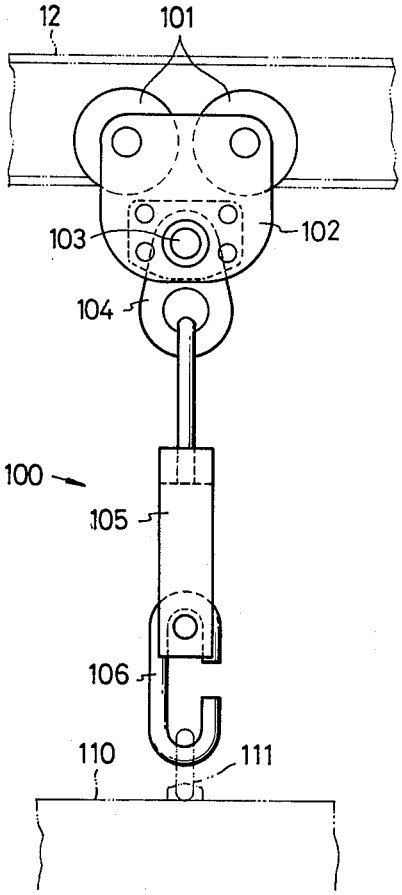
FIG. 5 is a side view thereof.

FIGS. 4 and 5 show a lifting device 100 having wheels. This lifting device 100 is engageable through wheels 101 thereof with opposite sides of the suspending rails 12, 13 . . . and the support rails 51 and so forth for the carrier bar 50, which are formed of I-steels, and comprises: two pairs of wheels 101 turning on one of the abovedescribed rails; a pair of frames 102 for rotatably supporting these wheels 101, respectively; a projecting shaft 103 racked across the lower portions of these frames 102 and projecting the opposite end portions thereof from the frames 102, the portions thus projected being engageable with dogs provided on a conveyor chain; a lug 104 with a hole supported at the upper end portion thereof by the projecting shaft 103 at a position intermediate the aforesaid pair of frames 102; a hanger 105 rotatably supported at the upper end portion thereof by the hole of the lug 104; and a C-shaped hook 106 rotatably supported at one end thereof by the lower end of the hanger 105 and engageable at the other end thereof with a lifting bolt 111 of the article 110 to be treated such as the reinforcement-arranged frame for the concrete panel; so that the lifting device 100 can smoothly move on one of the suspending rails 12, 13 and so forth in a state of lifting the article 110 to be treated.

In addition, reference numeral 29 in FIGS. 2 and 3 shows vent devices of the degreasing, pickling and neutralizing tanks 22, 24 and 26, and intake ports of vent hoods of the vent devices 29 are opened at longitudinally opposite sides of the respective treating tanks 22, 24 and 26.

Figure 6:
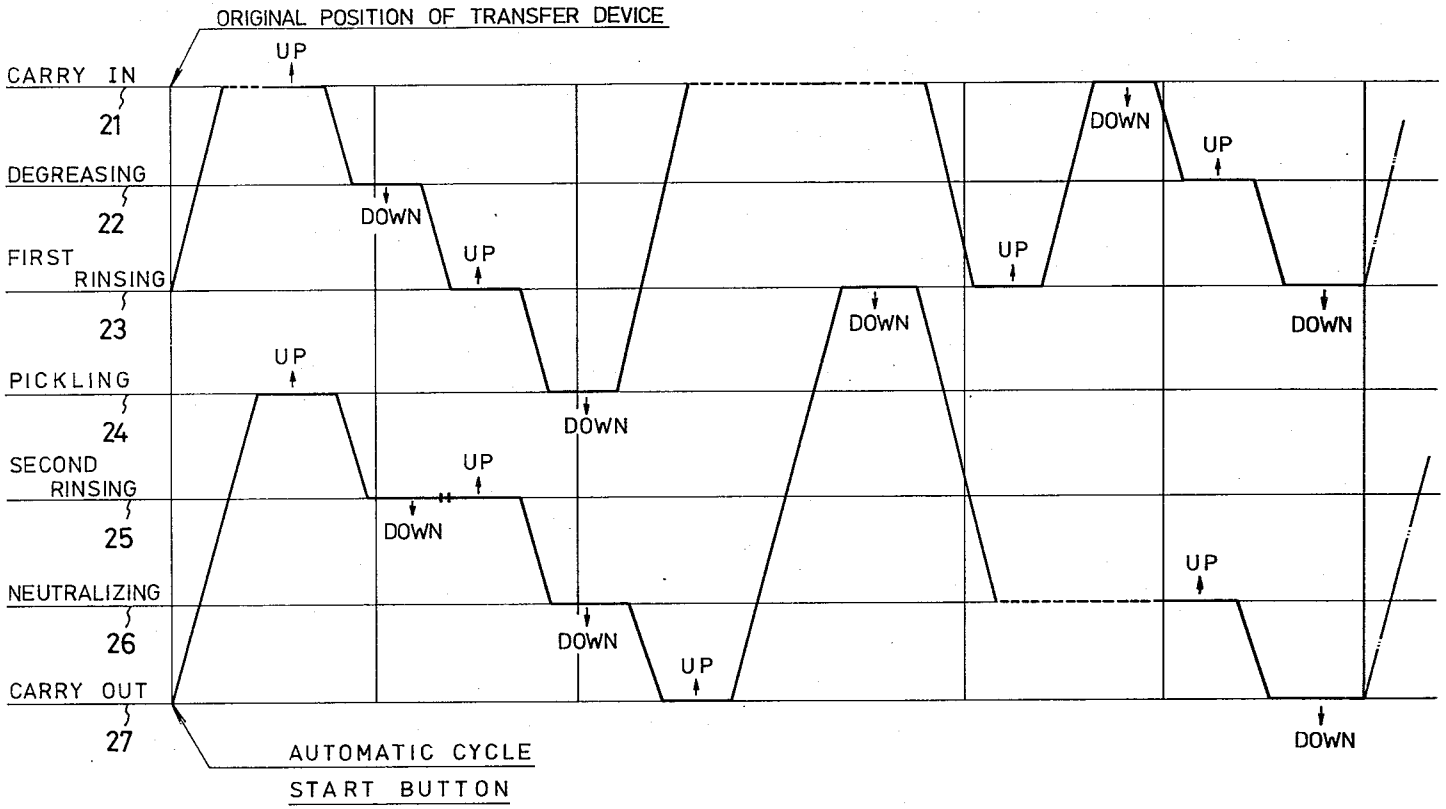
FIG. 6 is a time chart showing an example of the operation of this embodiment.

Description will hereunder be given of action of this embodiment with reference to the operation time chart of the corrosion protection pretreating apparatus 20 shown in FIG. 6 as well.

In FIG. 1, the article 110 to be treated, which has been delivered by means of the first traverser 10 is suspended through the lifting device 100 with wheels by an operator staying on a sling workboard. The article 110 to be treated, being suspended from the suspending rail 12 is manually or automatically carried into the carry-in section 21 of the corrosion protection pretreating apparatus 20. In this case, in the carry-in section 21, the support rail 51 of the carrier bar 50 is moved to be positioned on an extension line of the suspending rail 12 through the action of the carry-in carrier bar transfer device 80, whereby the article 110 to be treated is transfered from the suspending rail 12 onto the support rail 51 of the carrier bar 50 (Refer to FIG. 3).

Upon completion of the transfer of the article 110 to be treated to the carrier bar 50 as described above, the pusher cylinders 83 disposed at the opposite sides of the transfer device 80 are simultaneously operated to extend the piston rods thereof, whereby the movable bases 82 are moved to the carrier bar delivering and receiving positions indicated by two-don chain lines in FIG. 2. On the other hand, the first transfer device 63 is also moved to the carry-in section 21 through the action of the travel driving source 74 to receive the carrier bar 50 being at the carrier bar delivering and receiving position. In this case, the movable brackets 76 of the first transfer device 63 are positioned closely downwardly of the support projections 53 of the carrier bar 50, and, when the first transfer device 63 is stopped at the carrier bar delivering and receiving position, the movable brackets 76 are elevated through the action of the lifting driving source 78 and moved to travelling positions.

When the carrier bar 50 is received by the first transfer device 63, the latter is moved to the position of the degreasing tank 22 and stopped thereat, subsequently, the movable brackets 76 are lowered, whereby the article 110 to be treated is immersed into the degreasing tank 22. In this case, when the movable brackets 76 are lowered to disposed the article 110 to be treated at a properly immersed position, the receiving seats 54 of the carrier bar 50 are abutted against and supported by the receiving bases 28, and this state is maintained for a predetermined period of time. On the other hand, when the movable brackets 76 are further lowered to be completely separated from the carrier bar 50, the first transfer device 63 is driven to travel and be transferred to a position of the succeeding step of work, i.e. the position of the first rinsing tank 23, the article 110 to be treated, which has been immersed in the first rinsing tank 23, is lifted together with a carrier bar 50, further, this article 110 to be treated is transferred to a position of the succeeding step of work, i.e. the pickling tank 24, where the article 110 to be treated is immersed, and then, the first transfer device 63 being vacant (in a state of not supporting the carrier bar 50) is moved to the succeeding step of work. Additionally, the scope of movement of the first transfer device 63 is limited to the pickling tank 24 in this embodiment.

The article 110 to be treated thus immersed in the pickling tank 24 is pulled up together with the carrier bar 50 by means of the second transfer device 64, successively transferred to the second rinsing tank 25 and further to the neutralizing tank 26, finally transferred to the carry-out section 27 indicated by solid lines in FIG. 2 and delivered to the movable bases 92 of the carry-out carrier bar transfer device 90. The carrier bar 50 received by the transfer device 90 is moved to a position indicated by two-dot chain lines in FIG. 2, where the carrier bar 50 is manually or automatically transferred onto the suspending rail 13.

Description will now be given of the movements of the abovedescribed first and second transfer devices 63 and 64 in more detail with reference to FIG. 6.

At the time of starting of the first and second transfer devices 63 and 64 are automatically operated, i.e. the initial stage of a cycle, the first transfer device 63 is positioned at the first rinsing tank 23 and the second transfer device 64 is positioned at the carry-out section 27, both the transfer devices 63, 64 being vacant (the states of not supporting the carrier bars 50), respectively. When a start button is pressed or the cycle is started in the abovedescribed states, the first transfer device 63 pulls up the carrier bar 50 supporting the article 110 to be treated, which has been carried in as aforesaid, moves the latter to the degreasing tank 22 to immerse the same thereinto, the former becomes vacant again and is moved to the first rinsing treating tank 23, pulls up the article 110 to be treated, which has been immersed in the rinsing tank 23 in the preceding cycle, transfers the article 110 to be treated to the pickling tank 24 to immerse the same thereinto, the first transfer device 63 becomes vacant, is moved to the carry-in section 21 and stays there in a waiting condition for a predetermined period of time.

On the other hand, the second transfer device 64 is moved from the carry-out section 27 to the position of the pickling tank 24, pulls up the article 110 to be treated, which has been immersed in the pickling tank 24 in the preceding cycle, transfers the same to the second rinsing tank 25 to immerse the same thereinto, pulls up the same immediately thereafter, and transfers the same as it is to the neutralizing tank 26. In this case, the reason why the article 110 to be treated is immersed in the second rinsing tank 25 for only a short period of time is to prevent the article 110 to be treated from rusting. The second transfer device 64, which has been moved to the neutralizing tank 26 immerses the article 110 to be treated, which has been transferred thereto, into the neutralizing tank 26, becomes vacant, is moved to the carry-out section 27, supports the carrier bar 50, which has transferred the article 110 to be treated over to the suspending rail 13 to be vacant, is moved to the first rinsing tank 23, leaves the vacant carrier bar 50 thereat to become vacant, is moved to the neutralizing tank 26, stays there in a waiting condition for a predetermined period of time, thereafter, pulls up the article 110 to be treated, which has been immersed in the neutralizing tank 26, is moved to the carry-out section 27, delivers the article 110 to be treated to the carry-out carrier bar transfer device 90, becomes vacant, and further, repeats the abovedescribed cycle.

When the second transfer device 64 transfers the vacant carrier bar 50 to the first rinsing tank 23, the first transfer device 63, which has been waiting at the carry-in section 21, a little time after the second transfer device 64 has been moved to the carry-out section 27, e.g. in about two second thereafter, is moved to the first rinsing tank 23, where the first transfer device 63 receives the vacant carrier bar 50, is moved to the carry-in section 21 again, delivers the vacant carrier bar 50 to the carry-in carrier bar transfer device 80, becomes vacant, and is moved to the degreasing tank 22. Here, the first transfer device 63 pulls up the article 110 to be treated, which has been immersed in the degreasing tank 22 as aforesaid, is moved to the first rinsing tank 23, immerses the article 110 to be treated thereinto, becomes vacant, and further, repeats the abovedescribed cycle. The vacant carrier bar 50, which has been delivered to the carry-in carrier bar transfer device 80, is positioned on an extension line of the suspending rail 12 through the action of the pusher cylinders 83 in the retracting direction so as to be ready for the carry-in of the succeeding article 110 to be treated.

The article 110 to be treated, which has been transferred over to the suspending rail 13 from the corrosion protection pretreating apparatus 20, as shown in FIG. 1, is dried in a drain-and-dry furnace 32, thereafter, transferred to the position of the masking workboard 33, where positions, which should not be coated with mortar, e.g. joint areas for contacting other panels, threaded portions and the like, are applied thereonto with adhesive tapes or the like for masking, and then, transferred to the second traverser 34. The article 110 to be treated, which has been transferred to the traverser 34, is moved to the position of the suspending rail 14 by means of the traverser 34, and transferred to the suspending rail 14.

The article 110 to be treated, which has been transferred over to the suspending rail 14, is moved to the automatically operated corrosion protection treating tank 36, where the article 110 to be treated is immersed into a mortar liquid to be totally mortar-coated, and thereafter, moved to the corrosion protection drying chamber 37. The article 110 to be treated, which has been moved to this corrosion protection drying chamber 37, is transferred over to the movable rails 40 being intermittently movable so as to be moved from one side to the other side of the drying chamber 37, whence one requiring the repeated treatment is returned to the second traverser 34 through the conveyor 15 for the repeated treatment, transferred over to the suspending rail 14 again to be moved to the corrosion protection treating tank 36, where the article 110 to be treated in mortar-coated again. While, the article 110 to be treated requiring no repeated treatment is transferred over to the finished article conveyer 16.

The article 110 to be treated, which has been transferred over to the finished article conveyer 16, is transferred in turn to the suspending rail 17 through the third traverser 43, reaches the position of the masking removing workboard 44, where the adhesive tapes or the like, which have been applied onto the article 110 to be treated, are removed, is transferred to the traverser 45 having a lifter, where the lifting devices 100 having wheels are removed from the article 110 to be treated, and only the article 110 to be treated is carried out to the succeeding step of work by means of the traverser 45.

According to this embodiment with the abovedescribed arrangement, in the corrosion protection pretreating apparatus 20, the two transfer devices 63 and 64 are used and the plurality of carrier bars 50 are utilized to perform the most suitable pretreating operations in cosideration of the differences between the periods of time required for the treatments in the respective treating tanks 22 through 26, so that the operation efficiency can be improved, the changes in the respective treating steps can be accommodated only by changing the operation programs for the transfer devices 63 and 64, and moreover, a high production flexibility can be rendered.

Furthermore, the provision of the carrier bar transfer devices 80 and 90 in the carry-in section 21 and the carry-out section 27, respectively, makes it possible to perform the carry-in and carry-out operations for the article 110 to be treated during the movements of the first and second transfer devices 63 and 64, thereby enabling to improve the operation efficiency from this view point as well. Further, in the corrosion protection treating system including the corrosion protection pretreating apparatus 20, the production line is arranged in a zigzag fashion by the use of the second and third traversers 34 and 43 in suitable positions, so that the operations can be performed within a limited space at a high operation efficiency.

Furthermore, in working the present invention, the number of the treating tanks 22 through 26 and the details of the treatments in these treating tanks in the corrosion protection pretreating apparatus 20 may be differed from those described in the embodiment, and, the modes of transfer by means of the two transfer devices 63 and 64 may be entirely different from those shown in the time chart in FIG. 6. The carrier bar transfer devices 80 and 90 should not necessarily be provided, in which case the transfer devices 63 and 64 may directly carry in or carry out the articles 110 to be treated from the suspending rail 12 or to the suspending rail 13 in the carry-in section 21 or in the carry-out section 27. However, with the arrangement in the embodiment, such an advantage can be offered that the transfer devices 63 and 64 are utilized at a high efficiency. Further, the arrangement of the apparatus including the transfer devices 63 and 64, the carrier bar transfer devices 80 and 90, the number of the carrier bars 50 and so forth should not necessarily be limited to those in the embodiment, but, any of other arrangements may be adopted, for example, in the transfer devices 63 and 64, the constructions of the movable brackets 76 may be changed such that the carrier bars 50 can be simultaneously transferred.

As has been described hereinabove, according to the present invention, such an advantage can be offered as to provide a corrosion protection pretreating apparatus which can be operated at a high operation efficiency and under a high production flexibility.

What is claimed is:

1. A corrosion protection pretreating apparatus comprising:

a plurality of treating tanks including a pickling tank, rinsing tanks and the like;

a carry-in section for articles to be treated, provided at one side of a section of said treating tanks;

a carry-out section for the articles to be treated, provided at the other side of the section of the plurality of treating tanks;

a plurality of carrier bars capable of supporting the articles to be treated, being carried into said carry-in section for the articles to be treated and being transferred together with the articles to be treated to said carry-out section for the articles to be treated;

a first transfer device being movable between said carry-in section for the articles to be treated and predetermined positions over the plurality of treating tanks and having a lifting mechanism for supporting one or more of said carrier bars and vertically moving the carrier bar or bars; and a second transfer device being movable between predetermined positions over the plurality of treating tanks and said carry-out section for the articles to be treated with its scope of movement being partially overlapped with that of the first transfer device and having a lifting mechanism for supporting one or more of said carrier bars and vertically moving the carrier bar or bars.

2. A corrosion protection pretreating apparatus as set forth in claim 1, wherein each one carrier bar transfer device for linearly moving the carrier bar or bars to and from said treating tanks is provided in said carry-in section and said carry-out section for the articles to be treated, respectively.

3. A corrosion protection pretreating apparatus as set forth in claim 2, wherein said carrier bar transfer device comprises:

a pair of guide rails provided at opposite end portions of the carrier bar in opposed relation to each other;

transfer bases being linearly movable along said guide rails to and from the treating tank and supporting opposite end portions of the carrier bar; and push cylinders connected to said transfer bases for linearly moving said transfer bases.

4. A corrosion protection pretreating apparatus as set forth in claims 1, 2 or 3, wherein each of said first and second transfer devices comprises:

a frame racked across rails laid at opposite sides of each of the treating tank;

a travel driving source provided on the frame for driving wheels supported on the frame;

a pair of guide supports, the upper ends of which are supported by opposite sides of the frame and the lower ends of which are suspended to positions close to the ground;

movable brackets vertically movably secured to said guide supports and supporting the opposite end portions of the carrier bar; and lifting driving sources for vertically moving said movable brackets.

5. A corrosion protection pretreating apparatus comprising:

treating tanks including a degreasing tank containing an alkaline liquid, a first rinsing tank containing water, a pickling tank containing a corrosion removing liquid made of an acid, a second rinsing tank containing water and a neutralizing tank containing a neutralizing liquid, all of which are arranged in the described order;

a carry-in section for articles to be treated provided at one side of said degreasing tank and having a carrier bar transfer device for linearly moving the carrier bar to and from said degreaing tank;

a carry-out section provided at the other side of said neutralizing tank and having a carrier bar transfer device for linearly moving the carrier bar to and from said degreasing tank;

a first transfer device being movable between said carry-in section and predetermined positions over the plurality of treating tank and supporting one or more of said carrier bars;

a second transfer device being movable between predetermined positions over the plurality of treating tanks and said carry-out section with its scope of movement being partially overlapped with that of said first transfer device and supporting one or more of said carrier bars;

wherein each of said first and second transfer devices comprises:

a pair of support frames provided on opposite sides the treating tanks in directions of the plurality of treating tanks being arranged;

a frame being movable on rails laid on said support frames, respectively, through a plurality of wheels; a travel driving source provided on said frame for driving said wheels;

a pair of guide supports, the upper ends of which are supported by opposite sides of the frame and the lower ends of which are suspended to positions close to the ground;

movable brackets vertically movably secured to said guide supports and supporting the opposite end portions of the carrier bar; and lifting driving source for vertically moving said movable brackets.

* * * * *